US007504129B2

(12) United States Patent
Lindgren et al.

(10) Patent No.: US 7,504,129 B2
(45) Date of Patent: Mar. 17, 2009

(54) METHOD OF PRODUCING A FLOORING AND A FLOORING PRODUCED ACCORDING TO THE METHOD

(75) Inventors: Christer Lindgren, Halmstad (SE); Lars Askfelt, Halmstad (SE)

(73) Assignee: RA Golv AB, Halmstad (SE)

( * ) Notice: Subject to any disclaimer, the term of this patent is extended or adjusted under 35 U.S.C. 154(b) by 699 days.

(21) Appl. No.: 10/907,009

(22) Filed: Mar. 16, 2005

(65) Prior Publication Data

US 2006/0207213 A1 Sep. 21, 2006

(51) Int. Cl.
*B05D 1/36* (2006.01)

(52) U.S. Cl. ..... 427/203; 427/403

(58) Field of Classification Search ..... 427/202–205, 427/403; 52/741.41
See application file for complete search history.

(56) References Cited

U.S. PATENT DOCUMENTS

| | | | | |
|---|---|---|---|---|
| 1,361,763 | A | 12/1920 | Hamil | |
| 1,397,678 | A | 11/1921 | De Paoli | |
| 1,646,667 | A | 10/1927 | Tobin | |
| 2,010,025 | A | 8/1935 | Kirchner et al. | |
| 2,045,936 | A | 6/1936 | Wieger | |
| 2,296,453 | A | 9/1942 | Saffert | |
| 4,043,738 | A | 8/1977 | Modesto et al. | |
| 4,614,486 | A | 9/1986 | Bragagnini | |
| 5,185,192 | A | 2/1993 | Banus | |
| 5,281,050 | A | 1/1994 | Howard | |
| 5,339,589 | A * | 8/1994 | Thrower | 52/318 |
| 5,480,259 | A | 1/1996 | Thrower | |
| 5,702,651 | A | 12/1997 | Bean et al. | |
| 5,794,401 | A * | 8/1998 | Shaw et al. | 52/741.41 |

FOREIGN PATENT DOCUMENTS

| | | |
|---|---|---|
| CH | 361114 | 5/1962 |
| DE | 1509879 | 5/1969 |
| DE | 4225613 | 2/1994 |
| EP | 0 922 639 A * | 4/2000 |
| EP | 0992639 A1 | 4/2000 |
| FR | 2820446 | 8/2002 |
| SE | 512627 | 4/2000 |

OTHER PUBLICATIONS

International Type Search Report from SE 0300744-0 Aug. 25, 2005.
Communication pursuant to Article 96(2) EPC in corresponding European Application No. 04 075 677.7-2303.

* cited by examiner

*Primary Examiner*—Frederick J Parker
(74) *Attorney, Agent, or Firm*—WRB-IP LLP

(57) ABSTRACT

In a method of producing a flooring, a sub-floor is coated with a first layer of binder. A layer of aggregate material is spread over the binder which is then allowed to dry or set so that the particles bond therein. A second layer of binder is spread out over the first layer of binder and aggregate material bonded therein. A second layer of aggregate material is spread over the second layer of binder. Prior to drying or setting of the second layer of binder, the aggregate material of the second layer is mechanically processed to drive out air and in order to orient the particles of the aggregate material so that these turn their sharp edges and jagged tips away from the top side of the impending flooring. Finally, the flooring is allowed to dry or set, whereafter it is ground flat and even.

15 Claims, 4 Drawing Sheets

METHOD OF PRODUCING A FLOORING AND A FLOORING PRODUCED ACCORDING TO THE METHOD

BACKGROUND AND SUMMARY

The present application incorporates by reference the subject matter of SE0300744-0, filed Mar. 18, 2003. The present invention relates generally to a method of producing a flooring, and to a flooring. It is desirable to provide a method of producing a flooring that is simple and economical. It is desirable to provide a method of producing a flooring that permits the construction of floorings of thin layers. It is desirable to provide a method of producing a flooring that reduces the requirement for the removal of material in the final grinding operation.

In accordance with an aspect of the present invention, a method for the production of a flooring resting on a sub-floor is provided. The method comprises providing a first layer of binder on the sub-floor, spreading a first layer of aggregate material over the first layer of binder to bond the first layer of aggregate material therein, providing a second layer of binder over the bonded first layer of binder and first layer of aggregate material, spreading a second layer of aggregate material over the second layer of binder to bond the second layer of aggregate material therein, aggregate particles of the second layer of aggregate material being randomly oriented upon being spread over the second layer of binder and defining, with the binder material, an irregular upper surface, and grinding the irregular upper surface to form a smooth upper surface. Prior to allowing the second layer of binder to set and prior to grinding, the second layer of binder and the second layer of aggregate material are mechanically processed to remove air and to turn at least some of the aggregate particles of the second layer of aggregate material so that a volume of the irregular upper surface needed to be removed to form the smooth upper surface is reduced.

In accordance with another aspect of the present invention, a flooring to be smoothed by grinding comprises a first layer of binder, particles of a first layer of aggregate material spread over the first layer of binder and bonded therein, a second layer of binder spread over the bonded first layer of binder and particles of the first layer of aggregate material, and particles of a second layer of aggregate material spread over the second layer of binder and bonded therein. The second layer of binder and the second layer aggregate material are mechanically processed, relative to a random orientation of aggregate particles of the second layer of aggregate material, to remove air and to turn at least some of the aggregate particles of the second layer of aggregate material so that a volume of the irregular upper surface needed to be removed by grinding to form a smooth upper surface is reduced.

BRIEF DESCRIPTION OF THE DRAWINGS

The present invention will now be described hereinbelow, with reference to the accompanying Drawings. In the accompanying Drawings.

DETAILED DESCRIPTION

Figure 1:
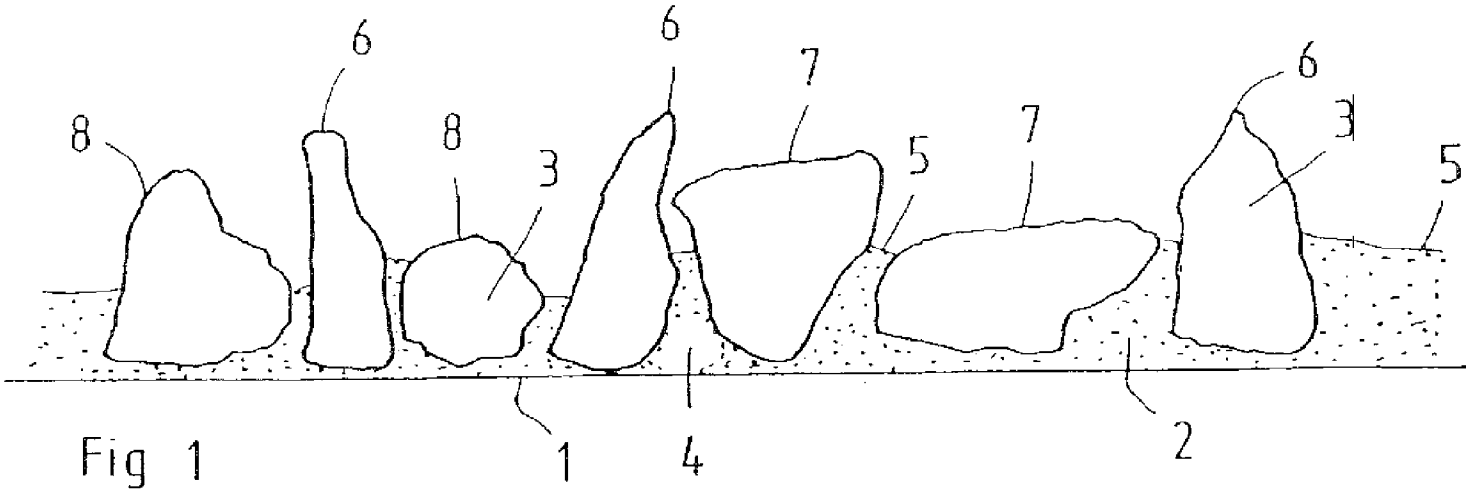
FIG. 1 is a cross section through a flooring in the process of construction, a first layer of aggregate having been bonded in a layer of binder on a sub-floor.

FIG. 1 shows a cross section through a flooring according to the present invention in the process of being built up and reference numeral 1 relates to a sub-floor or generally to a floor substrate. Reference numeral 2 relates to a layer of binder, for example epoxy based. The binder layer 2 is spread on the substrate 1, whereafter a first layer of particulate aggregate material, for example marble chips, are spread in the binder layer. The individual pieces or particles of aggregate material have been given reference numeral 3.

It is desirable to provide a thin flooring which saves material and which does not accumulate excessively in the vertical direction, it is important that the sub-floor or substrate 1 is completely flat. Should this not be the case, the sub-floor 1 is adjusted in this respect using a cement-based screed possibly followed by grinding before the first layer 2 of binder is spread out.

While it is not the intention, there may possibly occur small air pockets 4 in the binder layer 2, but as long as these pockets are not overly large or overly numerous, this is of no consequence to the quality of the flooring.

The binder in the first binder layer is applied in a quantity of approximately 0.2 kg per $m^2$ and the aggregate in a quantity of approximately 2 kg per $m^2$. This implies that the binder layer will have a thickness of the order of magnitude of 2 mm. The aggregate material need not be graded, but, in the relevant embodiment, has a maximum particle size of 3-5 mm.

It will be apparent from FIG. 1 that the individual particles or pieces 3 of aggregate are depressed in the binder layer 2 or alternatively have sunk down into it as a result of their higher density, for which reason the top surface 5 of the binder layer in FIG. 1 lies on a higher level than it did prior to application of the aggregate material, Given that the aggregate material may comprise, for example, crushed marble, cullet, crushed stone of types other than marble, wood chips, seashells etc., the individual pieces or particles 3 are of an irregular shape and the individual particles themselves may differ considerably in both shape and also size. In that the aggregate material is spread out over the binder layer 2 applied on the substrate 1, the individual particles or pieces 3 of aggregate material will be wholly randomly oriented. However, a certain orientation of the individual particles or pieces 3 may possibly be over-represented, where the pieces have their largest and flattest side turned to face downwards, since an upstanding piece or particle will probably show a tendency to "topple over". This is illustrated in FIG. 1 in that certain pieces of aggregate have upwardly extending jagged or sharp edges 6 while other pieces or particles may have largely planar surfaces 7 turned to face upwards, while still further pieces or particles may have arched surfaces 8 turned to face upwards. The foregoing also implies that the flooring in the process of being built up will have an upper surface that is extremely rough in the production stage it is in according to FIG. 1.

According to the present invention, it is possible (but not necessary), before the drying or setting of the first binder layer 2, to topple over, by mechanical processing of the first aggregate layer, such aggregate pieces or particles 3 as display the upwardly extending sharp edges 6 or points, onto their side. As a result, it is possible to reduce the roughness displayed by the flooring in this production stage.

In addition to, or possibly as an alternative to, the binder layer 2 applied on the substrate 1, it is possible to apply the binder on the individual pieces 3 of aggregate by running them in a suitable mixer with an addition of binder prior to the spreading operation.

Figure 2:
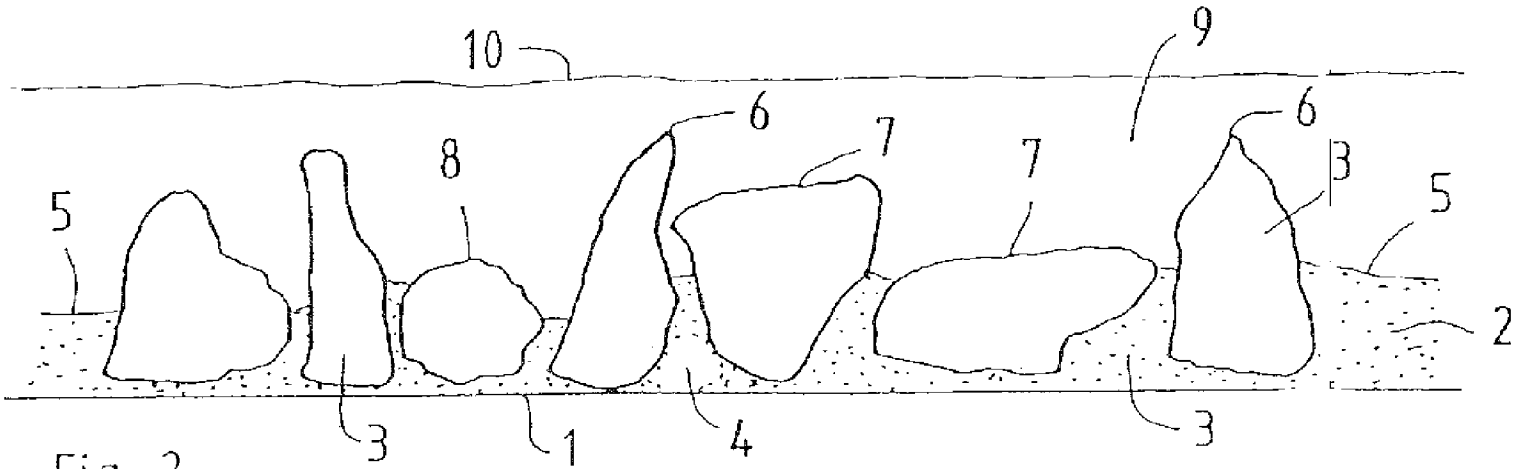
FIG. 2 shows the cross section of FIG. 1, a second layer of binder having been applied.

FIG. 2 shows the same cross section as FIG. 1, but after the next step in the production process where the flooring in the process of being built up has been given an additional layer of binder 9, a second layer of binder with the top surface 10. The binder in the second layer of binder is preferably of the same type, or at least same nature as the binder in the first layer 2.

The second layer 9 of binder is only applied once the first layer 2 has dried or set at least so far that the individual pieces or particles 3 of aggregate are properly bonded and can also most preferably be trodden on.

Since the binder in the second layer 9 is relatively fugitive, liqueform, or paste, it may be assumed that, at leas after the application in FIG. 2, it is largely free of air pockets.

The second layer of binder 9 is spread with a greater thickness than the first, and in such instance this thickness may lie in the order of magnitude of 3 to 4 mm, in which event the binder in the second layer 9 may also include filler in the form of aggregate material of finer grading than that which was otherwise employed, as well as colour pigment, suitably a colour pignlent which harmonises with the colour of the aggregate material employed. Ideally, the spreading of the binder in the second layer may be put into effect using a rubber scraper or similar implement, since the binder is liqueform or in paste form. The proportion of filler may be as much as two thirds of the total and the quantity may amount to 6 kg per $m^2$.

After the application of the second layer of binder 9, a second layer of particular aggregate 11 is applied or spread out, which, for example, may comprise to two thirds of a fraction having a particle size of 1-3 mm and to one third of a fraction having a particle size of 3-5 mm. The type of aggregate material is the same as in FIGS. 1 and 2 and the applied quantity amount to the order of magnitude of 4 kg per $m^2$.

In that the second layer of aggregate is spread out over the second layer of binder, the individual pieces or particles 11 in the aggregate material will initially be randomly oriented in the same manner as the individual pieces or particles 3 in the first layer of aggregate material were randomly oriented.

The next step of the production process entails that the individual particles 11 in at least the upper region of the second layer of aggregate are oriented by a mechanical processing so that, on the one hand, air is driven out, and, on the other hand, the individual pieces 11 or particles of aggregate material are at least partly caused to turn with their sharp and jagged edges 13 away from the top side of the impending flooring. After the mechanical processing and orientatin of the individual pieces 11 or particles in the second layer of aggregate material, the cross section through the flooring in the process of being built up will have the appearance as is apparent from FIG. 3.

Figure 3:
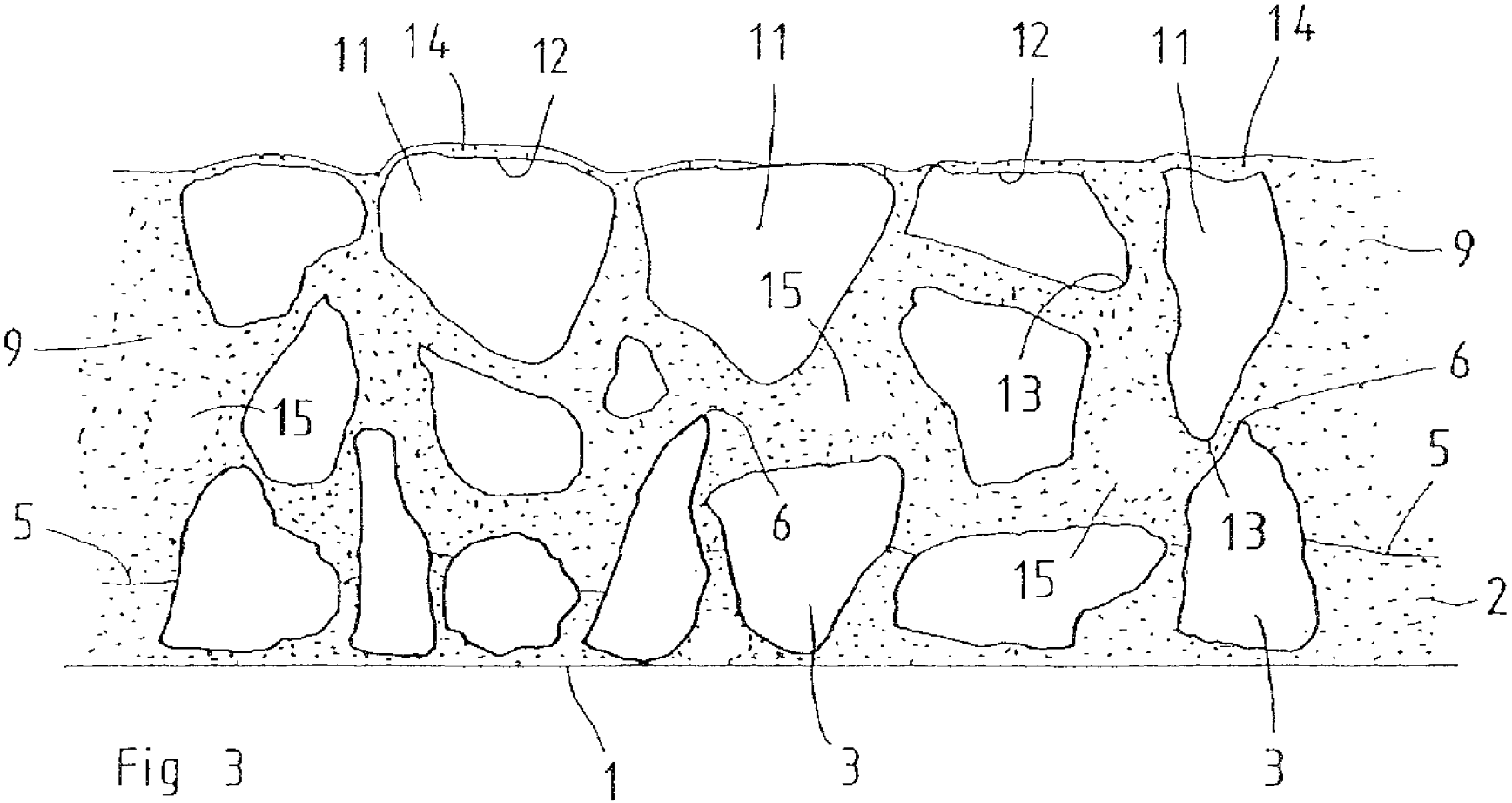
FIG. 3 shows the section according to FIG. 2, a second layer of aggregate having however been applied, and this second layer having been mechanically processed for orienting the individual pieces or particles of aggregate so that their flattest and smoothest sides are substantially turned to face upwards.

It win be apparent from FIG. 3 that the pieces of the aggregate material have, at least to some degree, been oriented in such a manner that their more or less planar surfaces 12 are turned to face upwards, while sharp edges and jagged portions 13 are turned to face away from the top side of the floor. It will also be apparent from the Figure that the pieces 11 are thoroughly surrounded by the binder 9 and that also a thinner layer 14 of the binder may be present on the upper side of the pieces 11. It is also largely apparent that there are no air pockets 15 in the second layer of binder 9, nor in the second layer of aggregate 11, possibly with the exception of the lower regions thereof.

The mechanical processing and orientation of the individual particles or pieces 11 proceeds such that these are subjected to forces which are substantially parallel with the upper defining surface of the flooring. This will cause the individual particles to turn to the positions illustrated in FIG. 3. The mechanical processing also entails that the individual particles are acted on by forces that are directed downwards towards the substrate 1 so that the particles will thereby be "kneaded down" into the binder 9, which, as a result, may float up to the top side of the individual pieces 11 and form the upper, thin layer 14.

During the mechanical processing of the upper layer of aggregate material, the lower layer of aggregate material functions as an arrest surface which prevents individual particles 11 or pieces in the upper layer of aggregate material from being depressed too far down so that the layer thickness in the flooring in the process of being formed locally may become too slight or that, in a later stage, a grinding down to an excessive grinding depth is required.

The peaks 6 of the lower layer of aggregate material may fulfill the same function as an arrest surface when the second layer of binder 9 is spread out using a suitable scraper.

Ideally, the mechanical processing of the second layer of aggregate material 11 may be put into effect employing spring-biased plates which move approximately parallel with the top surface of the layer and in contact therewith. In such instance, the individual sheets or plates make an acute angle with the substrate so that their front edges in the direction of movement lie somewhat higher than the rear edges. Through viscous forces in the second layer of binder 9 and as a result of direct mechanical friction between the plates and the individual pieces 11 of the aggregate material in the upper layer, these pieces 11 will be turned in the above-described manner and oriented with their substantially planar surfaces 12 facing upwards.

In that the mechanical processing of the second layer of aggregate material 11 entails an additional supply of energy, it is possible to reorient individual aggregate particles so that their point of gravity will be raised.

It is ordinarily desirable that the mechanical processing orient the particles aggregate material 11 so that a substantial portion of the particles are oriented so that larger and flatter surfaces of the particles face upwardly, as opposed to smaller, more jagged surfaces. What constitutes a substantial portion of particles will vary and may be any suitable portion greater than 0%, such as 10%, 20%, 30%, 40%, 50%, 60%, 70%, 80%, 90% or higher. It will be appreciated that mechanical processing will not ordinarily orient all particles in a desired manner. It is also ordinarily desirable that mechanical processing, usually by pressing particles of aggregate material 11 down, will press the uncured binder 9 upwardly between the particles of aggregate material to cover upper surfaces of the particles. It is also desirable that mechanical processing will press a substantial quantity of air out from spaces between particles of aggregate material 11, usually as a result of having uncured binder 9 rising from below, up into the spaces, thereby driving the air in those spaces upwardly to the surface.

Figure 5:
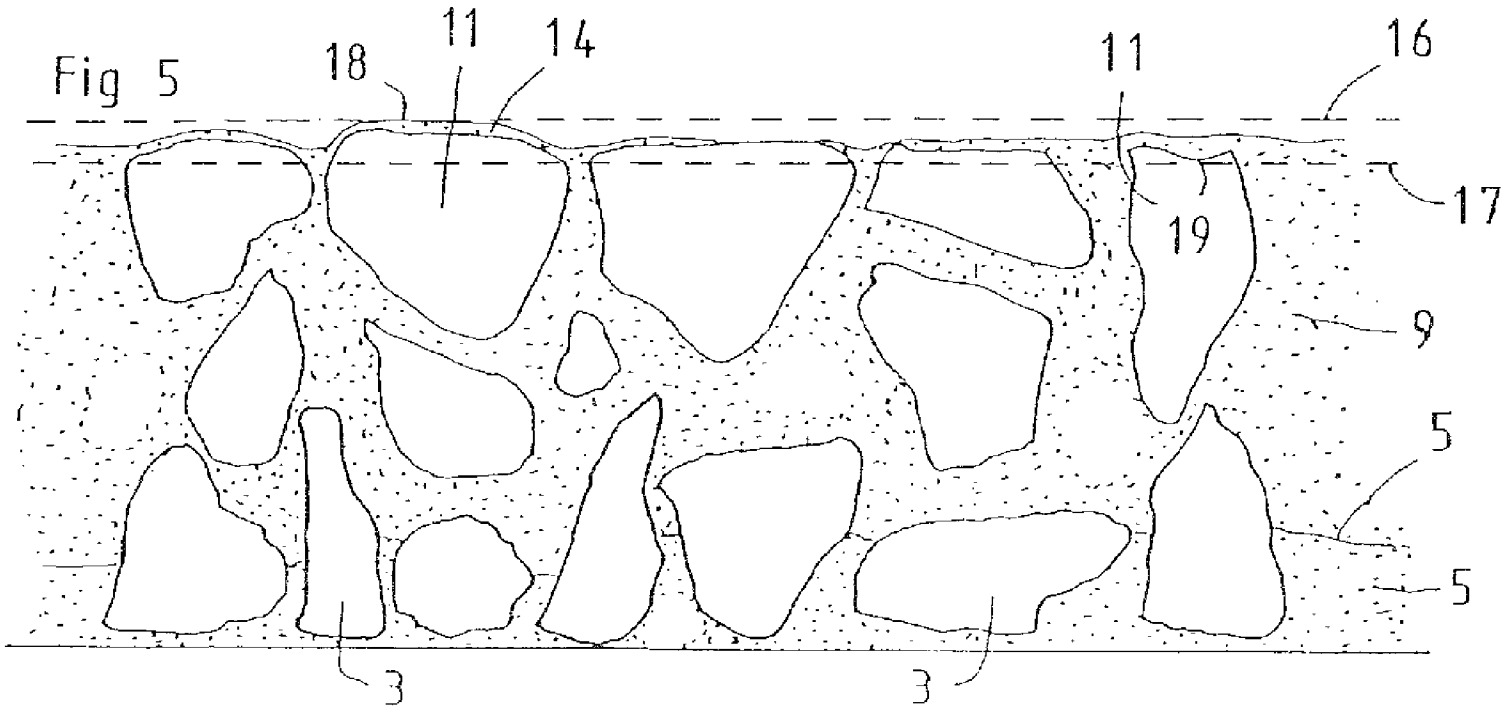
FIG. 5 shows the section according to FIG. 3, showing the amount of material that must be ground off before the flooring is smooth and flat.

The next step in the production process for the flooring entails that, after setting or drying of the second layer 9 of binder, the somewhat uneven and undulating upper surface of the flooring in FIG. 3 is to be ground totally flat, In this instance, FIG. 5 shows the quantity of material which must be removed for this to be put into effect. In FIG. 5, the upper, broken line 16 shows the level that corresponds to the upper point 18 in the flooring, in this case, the upper surface of the thin binder layer 14 which may exist on the top side of any individual particle or piece 11 in the upper layer of aggregate material. The lower broken line 17 shows the level of the lower point 19 where an individual piece or particle 11 of aggregate material has an upwardly facing, continuous grinding surface.

Figure 4:
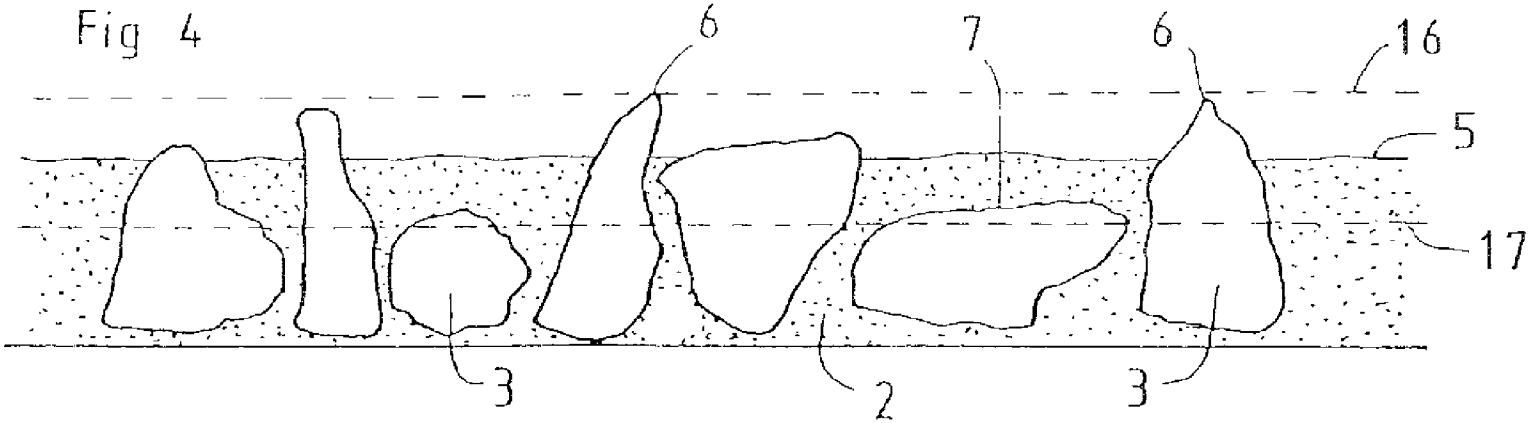
FIG. 4 is a section approximately according to FIG. 1 and indicates the thickness of material that must be removed if the flooring with unoriented pieces or particles of aggregate is to be flattened by grinding.

If an analogy is drawn with the grinding of the flooring in the state according to FIG. 1, the levels 16 and 17 would be found as shown in FIG. 4. It will readily be appreciated that, with randomly oriented pieces or particles in the aggregate material, the amount of material that must be ground off is considerably greater than is the case after an orientation of the individual pieces 11 carried out according to the present invention.

Figure 6:
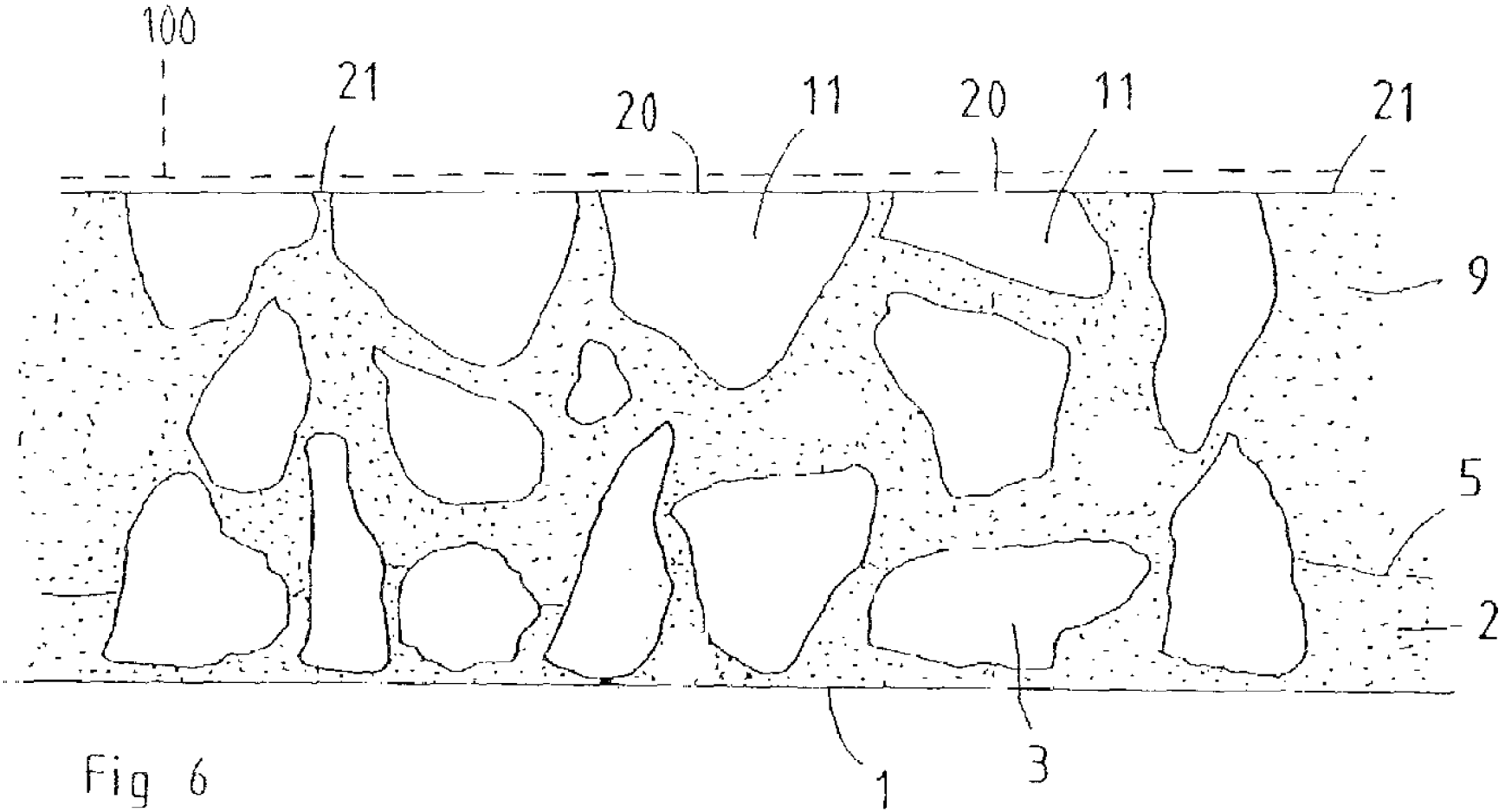
FIG. 6 shows the section according to FIGS. 3 and 5 in the flat-ground state.

After grinding down of the top surface of the flooring:, it will have the appearance which is apparent from FIG. 6. In such instance, it should be observed that the upper pieces 11 of aggregate material all display upper grinding surfaces 20 which lie in the one and same plane, while, on the other hand, the amount of binder 9 which is to be found in the upper surface 21 is considerably less.

The grinding process between the steps of the production process illustrated in FIGS. 5 and 6 takes place in several stages using gradually finer grinding material. In the last stages, use is made of an extremely fine particulate grinding material, possibly a pure polishing agent so that, as a result, the upper surface 20 and 21 will be smooth.

After grinding to the desired surface structure, the ground surface is sealed with a protective paint 100 (shown in phantom in FIG. 6), a wax or the like, whereafter a possible further polishing takes place.

In the present application, the use of terms such as "including" is open-ended and is intended to have the same meaning as terms such as "comprising" and not preclude the presence of other structure, material, or acts. Similarly, though the use of terms such as "can" or "may" is intended to be open-ended and to reflect that structure, material, or acts are not necessary, the failure to use such terms is not intended to reflect that structure, material, or acts are essential. To the extent that structure, material, or acts are presently considered to be essential, they are identified as such.

While this invention has been illustrated and described in accordance with a preferred embodiment, it is recognized that variations and changes may be made therein without departing from the invention as set forth in the claims.

What is claimed is:

1. A method for the production of a flooring resting on a sub-floor, comprising:

providing a first layer of binder on the sub-floor;

spreading a first layer of aggregate material over the first layer of binder to bond the first layer of aggregate material therein;

providing a second layer of binder over the bonded first layer of binder and first layer of aggregate material;

spreading a second layer of aggregate material over the second layer of binder to bond the second layer of aggregate material therein, aggregate particles of the second layer of aggregate material being randomly oriented upon being spread over the second layer of binder and defining, with the binder material, an irregular upper surface;

grinding the irregular upper surface to form a smooth upper surface; and prior to allowing the second layer of binder to set and prior to grinding, mechanically processing and reorienting the second layer of binder and the second layer of aggregate material to remove air and to turn at least some of the aggregate particles of the second layer of aggregate material so that a volume of the irregular upper surface needed to be removed to form the smooth upper surface is reduced.

2. The method as set forth in claim 1, comprising adjusting flatness of the sub-floor prior to providing the first layer of binder.

3. The method as set forth in claim 2, comprising adjusting flatness using a cement-based screed.

4. The method as set forth in claim 1, comprising providing an upper protective and sealing layer over the smooth upper surface.

5. The method as set forth in claim 1, wherein aggregate material forming the first layer of aggregate material is used as aggregate material for forming the second layer of aggregate material.

6. The method as set forth in claim 5, wherein binder forming the first layer of binder is used as binder for forming the second layer of binder.

7. The method as set forth in claim 1, wherein binder forming the first layer of binder is used as binder for forming the second layer of binder.

8. The method as set forth in claim 1, wherein aggregate material of the first layer aggregate material is randomly oriented.

9. The method as set forth in claim 1, comprising subjecting particles of aggregate of the second layer of aggregate material to forces that are substantially parallel with a plane of the flooring.

10. The method as set forth in claim 9, comprising subjecting particles of aggregate of the second layer of aggregate material to forces that are substantially directed toward the sub-floor.

11. The method as set forth in claim 1, comprising subjecting particles of aggregate of the second layer of aggregate material to forces that are substantially directed toward the sub-floor.

12. The method as set forth in claim 1, wherein, during the mechanical processing, the second layer of aggregate material is compressed such that the second layer of binder material is caused to rise relative to and cover upper surfaces of the particles of aggregate of the second layer of aggregate material.

13. The method as set forth in claim 12, wherein air is removed by compressing the second layer of aggregate material.

14. The method as set forth in claim 1, wherein air is removed by compressing the second layer of aggregate material.

15. The method as set forth in claim 1, wherein at least 10% of aggregate particles of the second layer of aggregate material are turned during the mechanical processing.

* * * * *